US007655135B2

(12) United States Patent
Havlik et al.

(10) Patent No.: US 7,655,135 B2
(45) Date of Patent: Feb. 2, 2010

(54) PROCESS FOR REMOVING SOLID PARTICLES FROM A HYDROPROCESSING FEED

(75) Inventors: Peter Z. Havlik, Tulsa, OK (US); Nathan Jannasch, Broken Arrow, OK (US); Paul Ahner, Tulsa, OK (US); H. Lynn Tomlinson, Tulsa, OK (US)

(73) Assignee: Syntroleum Corporation, Tulsa, OK (US)

( * ) Notice: Subject to any disclaimer, the term of this patent is extended or adjusted under 35 U.S.C. 154(b) by 49 days.

(21) Appl. No.: 11/375,452

(22) Filed: Mar. 14, 2006

(65) Prior Publication Data

US 2007/0215521 A1 Sep. 20, 2007

(51) Int. Cl.
*C10G 61/08* (2006.01)
*C10G 25/03* (2006.01)

(52) U.S. Cl. ..... 208/80; 208/58; 208/59; 208/60; 208/89; 208/97; 208/310 R; 422/191; 422/194

(58) Field of Classification Search ..... 208/58, 208/59, 60, 80, 89, 97, 310 R; 422/191, 422/194

See application file for complete search history.

(56) References Cited

U.S. PATENT DOCUMENTS

| | | | | |
|---|---|---|---|---|
| 2,771,407 | A | | 11/1956 | Penick |
| 3,876,533 | A | | 4/1975 | Myers |
| 4,003,829 | A | | 1/1977 | Burger et al. |
| 4,615,796 | A | | 10/1986 | Kramer |
| 5,157,054 | A | | 10/1992 | Herbolzheimer et al. |
| 5,763,716 | A | | 6/1998 | Benham et al. |
| 5,776,988 | A | | 7/1998 | Chaumette et al. |
| 5,827,903 | A | | 10/1998 | White et al. |
| 5,879,642 | A | * | 3/1999 | Trimble et al. ..... 422/191 |
| 6,201,030 | B1 | | 3/2001 | Beer |
| 6,239,184 | B1 | | 5/2001 | Beer et al. |
| 6,262,131 | B1 | | 7/2001 | Arcuri et al. |
| 6,656,342 | B2 | | 12/2003 | Smith et al. |

FOREIGN PATENT DOCUMENTS

| | | |
|---|---|---|
| EP | 0 230 146 | 7/1987 |
| GB | 1 475 813 | 6/1977 |
| GB | 2 276 353 | 9/1994 |
| WO | WO 02/055634 | 7/2002 |
| WO | WO 2004/011574 | 2/2004 |
| WO | WO 2005/002701 | 1/2005 |
| WO | WO 2005/097949 | 10/2005 |

* cited by examiner

*Primary Examiner*—In Suk Bullock
*Assistant Examiner*—Prem C. Singh

(57) ABSTRACT

The invention relates to a method of removing contaminants from a hydroprocessing feed stream. More specifically, the invention relates to a method of removing contaminants from a hydroprocessing feed stream which originates in a Fischer-Tropsch reactor using a guard bed that employs a temperature profile.

20 Claims, 3 Drawing Sheets

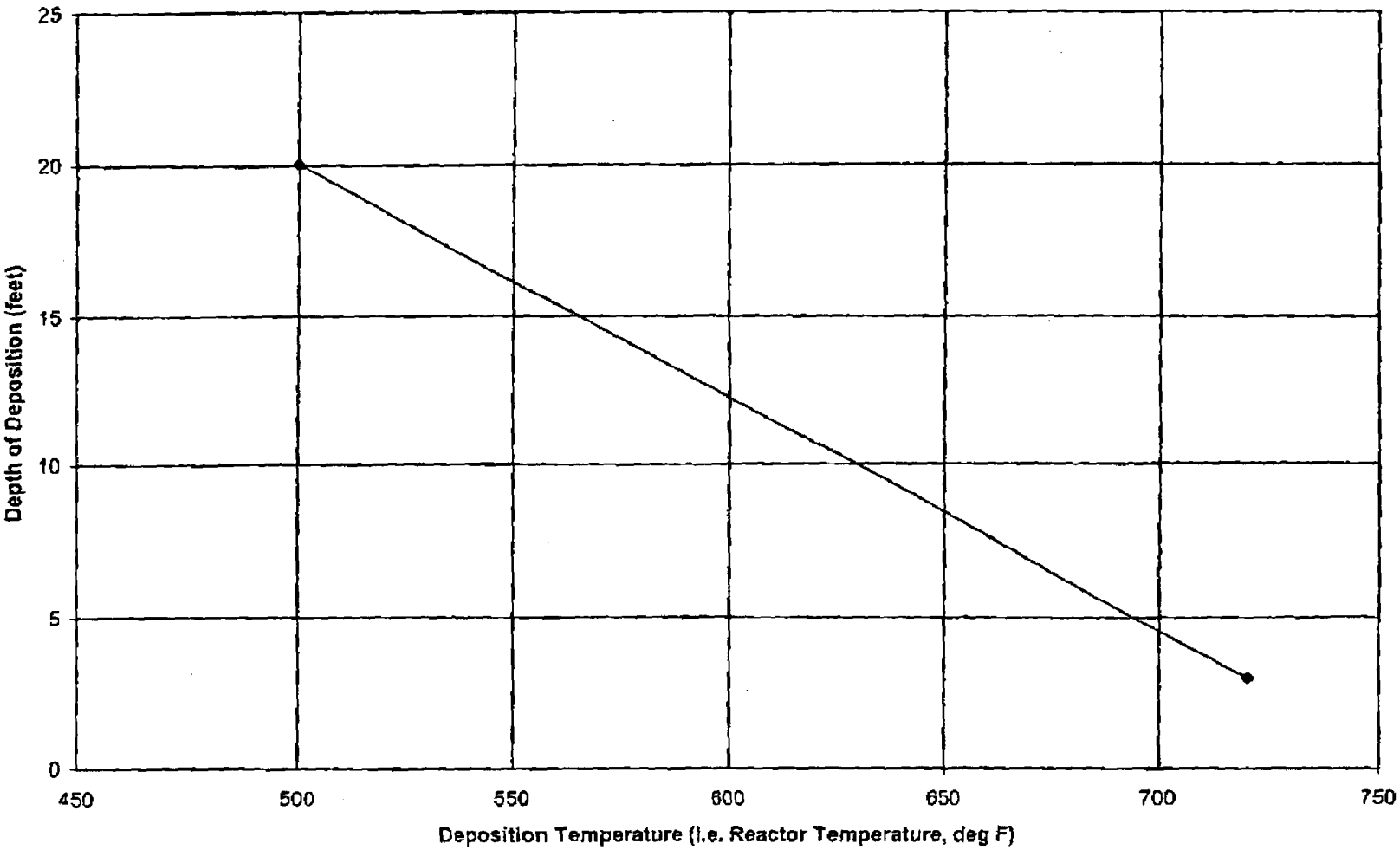
Fig. 3: FT Fines Deposition Profile vs. Operating Temperature
Depth of Deposition (feet)
25
20
15
10
5
0
450
500
550
600
650
700
750
Deposition Temperature (i.e. Reactor Temperature, deg F)

PROCESS FOR REMOVING SOLID PARTICLES FROM A HYDROPROCESSING FEED

PRIOR RELATED APPLICATIONS

Not applicable.

FEDERALLY SPONSORED RESEARCH STATEMENT

Not applicable.

REFERENCE TO MICROFICHE APPENDIX

Not applicable.

FIELD OF THE INVENTION

The invention relates to a method of removing contaminants from a hydroprocessing feed stream. More specifically, the invention relates to a method of removing contaminants from a hydroprocessing feed stream from a Fischer Tropsch reactor, using a guard bed that employs a temperature profile to control the distribution of the contaminants within the guard bed.

BACKGROUND OF THE INVENTION

The active catalyst beds of hydroprocessing reactors have to be protected from solids and dissolved contaminants that are present in the feedstock. Typical solids are mill scale, dirt, and debris left in piping during construction and turnarounds. Entrained and dissolved species that range from organometallic compounds (e.g. organic nickel, vanadium, arsenic species) to sodium and chloride salts are also problematic. The solids are generally dealt with by utilizing a guard bed at the reactor inlet that has layers of progressively smaller sized inert material with high void volumes to capture the different sizes of solids, sometimes called a graded bed. If organometallic species are present, the grading material can also be composed of either porous or active catalyst to entrain and/or react with the offending species.

In the Fischer-Tropsch slurry reactor process, finely divided catalyst is suspended in a molten wax (e.g., predominantly paraffinic hydrocarbon) by bubbling synthesis gas through the reactor. The unique reaction conditions experienced in slurry bubble column processes are extremely harsh. The slurry reactor process causes catalyst attrition products, also referred to as contaminants, to be produced and get passed on in the product stream. The hydrocarbon reaction products are recovered in the overhead stream and from a slurry discharged from the reactor. The contaminants concentrate in the wax fraction that goes to downstream upgrading processes. The downstream upgrading processes are operated at hydroprocessing conditions which are typically between about 300° F. and 850° F. catalyst temperature, between about 100 psig and 3500 psig hydrogen partial pressure and typically employ liquid hourly space velocities (LHSV) between about 0.25 $hr^{-1}$ and 5.0 $hr^{-1}$. These catalyst attrition products may still be reactive and detrimental to those upgrading processes, reducing efficiency and causing shut downs. Thus, catalyst attrition losses in slurry bubble column processes can be problematic for hydroprocessing conditions.

The FT catalyst contaminants are generally submicron, which are not readily removed by conventional filters and stay in the feed until they reach the downstream upgrading processes, such as, a hydrocracker reactor. Guard beds have been historically used to capture catalyst fines, trap piping debris (e.g., mill scale, valve packing, etc.) and organometallic contaminants. Traditional guard bed applications accommodate increasing feed solids and/or contaminants loadings by increasing the guard bed depth, volume or packing void volume, or combinations thereof. Traditional guard beds are not designed to capture submicron particulates since typical feed contaminants tend to pass completely through subsequent reactor beds. However, in the case of the present invention, FT contaminants behave differently and hence need a new approach to effectively remove the submicron particulates.

A characteristic of FT catalyst contaminants is their propensity to form agglomerates in the catalyst beds of the hydroprocessing reactors. The agglomerates range from fairly stable to very fragile—the fragility indicated by its ability to waft in air upon disturbing the agglomerates. The FT agglomerates form in the interstitial spaces between particles (packing) and cause the packed bed to bridge (sometimes referred to as "plugging") with increasing differential pressure being the result. The consequence of increasing differential pressure is the shortening of the run length for a given catalyst load which results in less production of products per annum.

When a hydroprocessing reactor experiences a high pressure drop associated with plugging, circulating a low viscosity diesel (or sometimes just recycle gas) through the unit can temporarily reduce the pressure drop when the wax feed is restarted. The pressure drop usually rises more rapidly with each successive attempt. It has been theorized that the change in flow regimes disturbs the bed and allows some of the agglomerates to redistribute themselves deeper into the bed.

Another unique feature of FT contaminants is the fact that they can form significant amounts of methane at hydrocracker operating conditions. Typical organometallic contaminants present in petroleum fractions do not produce methane at hydroprocessing conditions. It is believed that the cobalt present in the FT contaminants is responsible because of its methanating tendencies in the absence of hydrogen sulfide.

Another phenomenon that has been observed is exotherms in catalyst beds attributed to FT catalyst contaminants. Exotherms can occur at catalyst temperatures as low as ~700° F. No exotherms have been experienced at hydrotreating temperatures (450-550° F.). Data to relate exotherm potential to FT catalyst fines concentration does suggest that higher concentrations of FT catalyst contaminants promotes instability.

Fischer-Tropsch catalyst typically employ a support material, primary active metal component and promoters. The support material can be alumina, titania, silica or combinations thereof. The metal component is traditionally cobalt, iron, ruthenium, platinum or nickel. Promoters are trace amounts of metal salts which promote certain reactions over others. FT catalyst contaminants that manage to get into the hydrocracker have a strong tendency to agglomerate. It is theorized that the combination of two-phase flow, the presence of hydrogen, and the low viscosity of the fluid at high temperatures promotes agglomeration of the submicron particles.

The plugging of the catalyst bed reduces operating runs, increases turnaround frequency and operating costs, and decreases plant efficiency. Additionally, methane production from FT liquids processing is undesirable. As demand for petroleum products increase, plant efficiency must be improved. Therefore, a method that removes solid particles from hydroprocessing feeds is needed.

SUMMARY OF THE INVENTION

BRIEF DESCRIPTION OF THE DRAWINGS

FIG. 3 is a graph depicting a fines deposition profile vs. operating temperature.

DESCRIPTION OF EMBODIMENTS OF THE INVENTION

Figure 1:
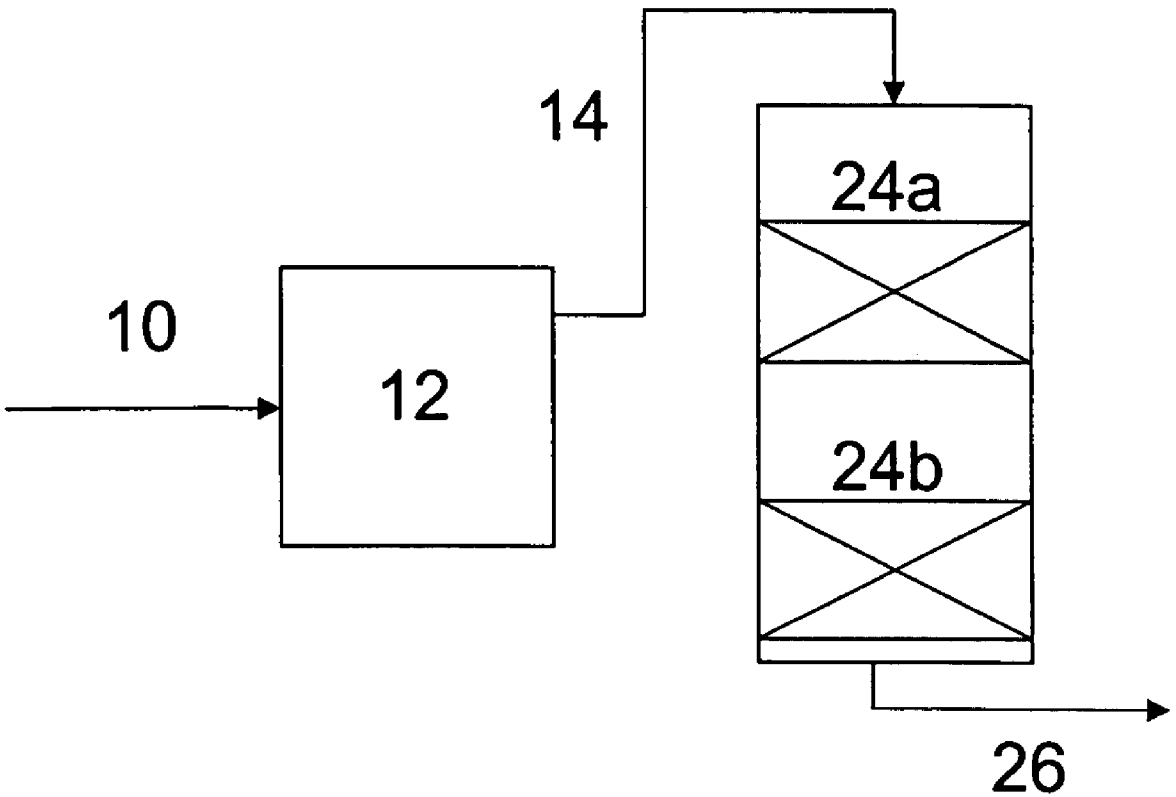
FIG. 1 is a flow diagram of an embodiment of a process for removing solids from a hydroprocessing feed having <3 ppm contaminants.

Unless otherwise specified, all quantities, percentages and ratios herein are by weight.

The invention will be described in terms of an FT reactor product being sent for product upgrading. Product upgrading typically includes hydroprocessing reactions, including hydrotreating and hydrocracking. However, the invention is not limited to FT products and hydroprocessing reactions. Any process that produces catalyst attrition contaminants that are not filterable by conventional filtering will benefit from embodiments of the invention.

The most difficult filtration component of the FT catalyst contaminants is referred to as nanotrash or nanodebris. Nanodebris are defined as less than about 1 micron in size and will generally be less than about 0.1 micron. It should be noted that FT catalyst contaminants and especially the nanotrash component can exist in feed streams as suspended solid, colloidal, and/or solubilized constituent.

The term "hydrotreating" as used herein refers to processes wherein a hydrogen-containing treatment gas is used in the presence of suitable catalysts which are primarily active for saturating olefins and aromatics. Suitable hydrotreating catalysts for use in the present invention are any known conventional hydrotreating catalysts. Examples of such hydrotreating catalyst include, for example, those comprised of at least one Group VIII metal, preferably iron, cobalt and nickel, more preferably cobalt and/or nickel on a high surface area support material, such as alumina. Other suitable hydrotreating catalysts include both amorphous and/or zeolitic catalysts, as well as noble metal catalysts where the noble metal is selected from palladium and platinum. More than one type of hydrotreating catalyst may be used in the present invention. Typical hydrotreating temperatures range from about 300° F. to about 850° F. with pressures from about 100 psig to about 3500 psig hydrogen partial pressure. Olefin saturation with noble metal catalysts may be performed at milder conditions, with temperatures as low as 100° F. and pressures as low as 1 atmosphere.

The term "hydrocracking" as used herein refers to a process having all or some of the reactions associated with hydrotreating, as well as cracking reactions, which result in molecular weight and boiling point reduction and molecular rearrangement, or isomerization. Hydrocrackers may contain one or more beds of the same or different catalyst. In some embodiments, when the preferred products are middle distillate fuels, the preferred hydrocracking catalysts utilize amorphous bases or low-level zeolite bases combined with one or more Group VIII or Group VIB metal hydrogenating components. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc.

Referring to FIG. 1, an embodiment of the invention has a Heavy Fischer-Tropsch Liquid (HFTL) 10 from Fischer-Tropsch (FT) reactors being sent for hydroprocessing. At the FT reactors, the HFTL contains solid particles ranging from less than about 0.1 micron to about 100 microns. The HFTL is filtered at the FT reactor to remove larger solid particles which may be, but are not limited to, catalyst particles, refinery scale, corrosion products, dirt, weld slag, graphite or polymers. As used herein, the term "catalyst particles" may include, but are not limited to, products of catalyst attrition, fractioning, and/or deaggregation and may include catalyst support components and/or active metals. The filter at the FT reactors may be any filter which removes larger solid particles. In alternate embodiments, there may be one or more filters. In a preferred embodiment, the filter removes particles that are greater than about 5 microns. Embodiments of the filter may be a cross-flow filter, cyclone type, bag filter, backwashing type, sand filter (fixed bed), cartridge filter or combinations thereof.

In one embodiment, the HFTL 10 has ≦3 ppm contaminants. The HFTL 10 is fed to a heater 12 which heats the HFTL to a temperature of ranging from approximately 400° F. to 750° F. The heated HFTL 14 is fed to a hydroprocessing unit 24. In a preferred embodiment the hydroprocessing unit is a hydrocracker. The hydrocracker has a guard bed 24*a* and a hydrocracking bed 24*b*. Hydrocrackate 26 exits the hydrocracking bed 24*b* and is either sent for further processing or to storage. In an alternate embodiment, there may be more than one guard bed 24*a*. In an alternate embodiment, there may be more than one hydrocracking bed 24*b*. In an alternate embodiment, the guard bed 24*a* may be upstream the hydrocracker 24. In an alternate embodiment, the hydroprocessing unit 24 is a hydrotreater. In this embodiment, the temperature profile of the guard bed 24*a* and hydrocracker bed 24*b* are not independent of each other.

Figure 2:
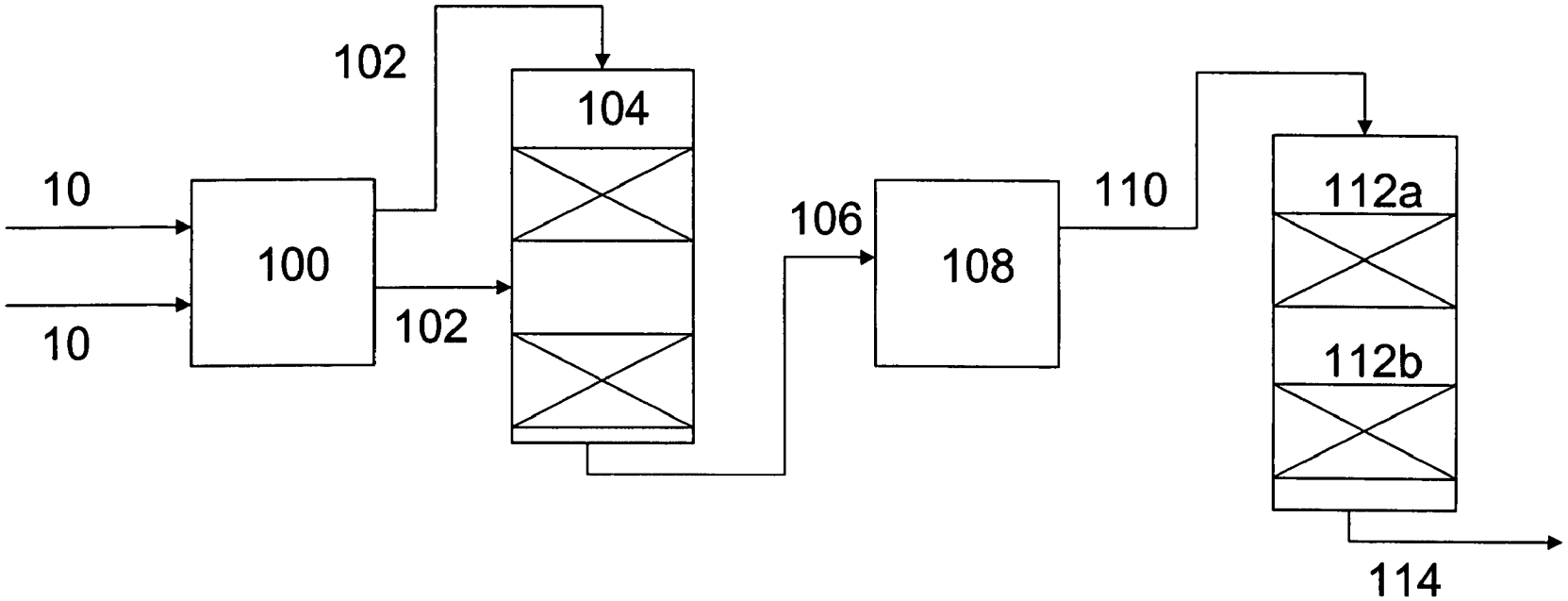
FIG. 2 is an alternate flow diagram of an embodiment of a process for removing solids from a hydroprocessing feed having >3 ppm contaminants.

In an alternate embodiment, referring to FIG. 2, the HFTL has ≧3 ppm contaminants. A Heavy Fischer-Tropsch Liquid (HFTL) 10 from FT reactors is filtered upstream of the hydroprocessing unit to remove larger solid particles as described above. The HFTL is split into two streams and fed to a guard bed heater 100 which heats the HFTL to a temperature ranging from approximately 400° F. to 750° F. The heated HFTL 102 is fed to a guard bed reactor 104. Guard bed effluent 106 is then fed to a hydroprocessing heater 108. The heated guard bed effluent 110 is then fed to a hydrocracker 112. In a preferred embodiment, the hydrocracker 112 has a guard bed 112*a* and a hydrocracking bed 112*b*. Hydrocrackate 114 exits the hydrocracking bed 112*b* and is either sent for further processing or to storage. In this embodiment, the temperature profile of the guard bed 104 can be adjusted independently of the hydrocracker 112 to optimize the solids loading profile in guard bed 104. In this embodiment, the temperature profile of the guard bed 104 and hydrocracker bed 112*b* are independent of each other.

In another embodiment, the guard bed reactor 104 is a parallel bed reactor. In alternate embodiments, the guard bed reactor may be, but not limited to, a multiple bed reactor, a swing bed reactor, or a two phase radial flow reactor.

In an alternate embodiment, there may be more than one guard bed 112*a*. In an alternate embodiment, there may be more than one hydrocracking bed 112*b*. In an alternate embodiment, the hydrocracker, either 24*b* or 112*b*, is a different hydroprocessing unit, such as, but not limited to, a hydrotreater, a catalytic dewaxer, a hydrofinisher, a dehydration unit, and/or a reforming unit. In another embodiment, there is more than one hydroprocessing unit and a guard bed is employed on all of the hydroprocessing units. In another embodiment, there is more than one hydroprocessing unit, and only the hydrocracker reactor employs a guard bed of this invention while the other hydroprocessing units, do not employ the guard bed of this invention.

For the following discussion, the term "guard bed" encompasses either a guard bed within the hydroprocessing unit 24*a* or 112*a*, or a guard bed that is independent of the hydroprocessing unit 104. The guard bed is filled with a high void volume inert material. To maximize the ability to trap solids, the guard bed consists of high void volume extrudates. The high void volume is preferably a catalytically inactive support material. The packing need not be porous. The packing is typically made of ceramic or alumina materials, but is not limited to these materials. The extrudates are generally composed of alumina and are in the shape of hollow cylinders, which provide a high void volume (e.g. over 50%) while retaining their ability to trap the solids. Shapes of the packing also include saddles or rings, but are not limited to these shapes. The majority of the bed should be composed of a single material type. In embodiments of the invention, slightly smaller packing should be placed towards the bottom of the bed to prevent contaminants from migrating to the active catalyst bed. Examples of the high void volume material may be, but are not limited to, Denstone® 2000 by Saint-Gobain Norpro, 835 HC by Criterion Catalyst Co., or TK-30 by Haldor Topsoe.

The guard bed size (length) is determined by the concentration of contaminants and the run length required before the contaminants either plug the bed or exceed the bed capacity and begin to bleed through and poison the active catalyst beds below. Factors used for setting the minimum acceptable contaminants concentration include the following: cycle time, holding capacity, and geometry. The typical cycle time between shutdowns is typically 6 months, preferably 1 year, more preferably 2 years. During shutdowns, the guard bed can be dumped and re-filled with new high void volume inert material or the material can be regenerated and used again. The holding capacity for high void volume packing is from about 5 to about 6 pounds of solids per $ft^3$ of reactor volume. Because not all of the void volume of the entire bed can be efficiently utilized, the holding capacity is discounted yielding a conservative design value of less than 5 pounds of solids per $ft^3$ of reactor volume. Depending upon the temperature profile and the contaminant loading, the bed depth for solids deposition is generally limited to about the first 3 linear feet, preferably 5 linear feet, more preferably 10 linear feet, and most preferably 20 linear feet.

The theoretical capacity of a bed is obtained by measurements and experimentation whereas actual run length must take into account items such as flow rate and temperature. To obtain the theoretical capacity of the bed, the following factors are required: packing density of the contaminants within the packing (contaminants bulk density); void volume of the packing (voidage); bed volume of the packing; utilization factor (percentage of the total void volume filled with solids at EOR). These factors combine to give an overall capacity of the Guard Bed as follows.

Capacity Factor (lbs/ft3)={Contaminants Bulk Density}*{Voidage}*{Utilization Factor}

Capacity at *EOR* (lbs of solids)={Capacity Factor}*{Bed Volume}

The Capacity Factor is useful for estimating the size of the bed required to hold a given amount of solids. The bulk density of the deposited contaminants has been measured experimentally and ranges from about 0.27 to about 0.34 g/cc (about 16.8 and about 21.2 $lbs/ft^3$, respectively). Given that catalyst contaminants material can be of varied chemical composition, it is expected that the bulk density of deposited contaminants could vary proportionately with the density of the original catalyst support/formulation. An average bulk density of about 19 $lbs/ft^3$ is used for calculational purposes in this example. The void volume is a characteristic of the packing and can either be measured or calculated. The table below provides (calculated) examples of materials that have been tested to date. The run length can be estimated by simply calculating the mass of contaminants coming in with the feed (i.e. ash*charge rate).

TABLE 1

Void Volumes of Various Packings from the CDF

| Name | Size & Shape | Voidage |
|---|---|---|
| Denstone Balls | ½" spheres | 0.40 |
| 835 HC | 8 mm rings | 0.53 |
| TK-30 | 3/16" rings | 0.57 |

1. Aspect Ratio is the Length to Diameter Ratio.
2. Diameter Ratio is the ratio of the inside diameter to the outside diameter for hollow cylinders.
3. Voidage is ±0.04 and depends upon how the packing is loaded (i.e. dumped, sock loaded, or dense loaded).

The utilization factor is included to account for the realities of solids laydown. For example, the bed ΔP design limit will be exceeded before the bed is even 80% full. The main factors contributing to the utilization factor are:

Gas-to-oil (G/O) ratio: The higher the G/O ratio, the greater the pressure drop (for gas phase continuous systems).

Mass flux: Lower mass fluxes are expected to allow a higher utilization factor due to lower velocities which promotes solids laydown. Too low a mass flux however can increase the likelihood of channeling. A preferred mass flux would be $\geqq 500$ $lb/hr/ft^2$, a more preferred mass flux would be $\geqq 1000$ $lb/hr/ft^2$.

Deposition profile within the bed: If the deposits occur in a very narrow range, then the utilization factor may be only 10-20% of the available capacity within the bed.

From the bed capacity calculated from the aforementioned information, the run length can be estimated by simply calculating the mass of contaminants coming in with the feed (i.e. ash*charge rate).

$$\text{Cycle Time (days)} = \frac{\text{Guard Bed Capacity Factor } (lbs/ft^3) * \text{Bed Volume } (ft^3)}{\text{Ash } (ppm) * \text{Feed Rate } (BPD) * \text{Feed Density } (g/cc) * \text{conversion factor } (3.505 \times 10^{-4})}$$

For example, a 20,000 BPD Gas-to-Liquids plant will generate about 9,000 BPD of feed to a hydrocracker with an API gravity of 43.2 (0.81 g/cc). Assuming a 20 ppm ash value, about 51 lbs/day of solids will be laid down. To extend cycle time, a separate guard bed vessel is used with a mass flux half that of a normal fixed bed reactor. Two beds are used to extend the cycle time between shutdowns. The utilization factor of 60% is based upon a separate guard bed vessel with its own heater. The calculation is summarized below:

| | |
|---|---|
| GTL design basis, BPD | 20,000 |
| Hydrocracker charge, BPD | 9,000 |
| Feed specific gravity, g/cc | 0.81 |
| Ash, ppm | 20 |
| Total solids, lbs/day | 51 |
| Fines Bulk Density, lbs/ft3 | 19 |
| Packing Voidage | 0.57 |
| Utilization Factor, % | 60 |
| Capacity Factor, lbs/ft$^3$ | 6.5 |
| Mass flux, lb/hr/ft$^2$ | 1,500 |
| Reactor Diameter, ft | 9.5 |
| Bed Length, ft | 20 |
| # of Beds | 2 |
| Guard Bed Volume, ft$^3$ | 2,840 |

Cycle Time = 360 days

Temperature is a factor affecting the deposition of FT contaminants in the guard bed. Historically, deposition of contaminants could be seen at elevated temperatures (i.e. above about 500° F.) by monitoring pressure drop during the course of a run. FT catalyst, more preferably cobalt based slurry catalyst, has been shown that the higher the temperature, the faster the agglomerization and solids lay down.

FIG. 3 shows a very simplified temperature deposition profile that is useful for two parameters—primarily, how to establish the guard bed heater operation for maximum utilization of the guard bed packing and secondly, if the guard bed is part of the hydrocracker reactor, how much of the packing will be available for accumulating deposits given the SOR temperature of the hydrocracker.

The deposition zone is highly temperature dependent, therefore, to utilize more of the guard bed for deposition, the feed temperature to the guard bed is controlled. Generally, the start of run (SOR) temperature will be lower allowing solids to deposit deeper into the bed and then, as the void volume is occupied by FT contaminants (observed by an increase in the pressure drop), the temperature is increased allowing the contaminants to deposit higher in the bed. By slowly increasing the temperature during the life of the guard bed, its capacity can be greatly increased relative to the case of a single temperature operation. Alternatively, the temperature may initially be set high and reduced over the life of the guard bed. The guard bed temperature is used to evenly distribute the lay down of solids in the bed, extending the pressure drop increases and the service life of the guard bed.

Given the temperature requirements for deposition (i.e. SOR as low as 500-550° F.) it is necessary to have a fired heater ahead of the guard bed reactor. In alternate embodiments, heat integration (i.e. feed effluent exchangers) may also be used to heat the feed. One skilled in the art would be able to design the guard bed and associated heat integration.

As seen in FIG. 3, the depth of contaminants deposition in a hydroprocessing reactor is inversely proportional to the hydroprocessing reactor temperature. At low temperatures such as those in the hydrotreater (i.e. 500° F.), the agglomerates do not appear until almost 20 feet into the catalyst bed. At temperatures in the 700° F. range, the deposition occurs with the first several feet of the reactor bed.

In an alternate embodiment, there are two guard beds operating in parallel so that one guard bed can always be in operation while the other is being regenerated or cleaned. In alternate embodiments, the guard bed has multiple beds which operate in swing mode, or in series.

While the invention has been described with respect to a limited number of embodiments, the specific features of one embodiment should not be attributed to other embodiments of the invention. No single embodiment is representative of all aspects of the inventions. Moreover, variations and modifications therefrom exist. For example, other separation process units can be used in place of a traditional filter. Additionally, heat exchangers and preheaters may be designed for maximum heat efficiency. The appended claims intend to cover all such variations and modifications as falling within the scope of the invention.

What is claimed is:

1. A process for removing inorganic solid contaminants 10 microns and smaller from a hydroprocessing feed stream comprising the steps of:

feeding a contaminated hydroprocessing feed stream having inorganic solid contaminants at least 10 microns and smaller to at least one guard bed operating at hydroprocessing conditions; and incrementally increasing or decreasing with time the average bed temperature of the at least one guard bed to control the distribution of the inorganic solid contaminants 10 microns and smaller within the at least one guard bed.

2. The process of claim 1, wherein the at least one guard bed is loaded with an inert high void volume material.

3. The process of claim 1, wherein the hydroprocessing feed stream comprises a Heavy Fischer-Tropsch Liquid product stream.

4. The process of claim 1, wherein the at least one guard bed is within a hydroprocessing unit.

5. The process of claim 4, further comprising feeding the hydroprocessing feed stream to at least one guard bed upstream of the hydroprocessing unit.

6. The process of claim 4, wherein there are two guard beds which operate in parallel, swing, or series.

7. The process of claim 1, wherein the hydroprocessing feed stream is filtered prior to entering the at least one guard bed.

8. The process of claim 1, wherein the contaminated hydroprocessing feed stream has inorganic solid contaminants which are predominantly less than about 1 micron in size.

9. The process of claim 2, wherein the inert high void volume material has a void fraction of from about 0.4 to about 0.6.

10. The process of claim 1, wherein the inorganic solid contaminants are attrition products from a Fischer-Tropsch catalyst.

11. The process of claim 4, wherein the hydroprocessing unit comprises a hydrocracker.

12. The process of claim 4, wherein the hydroprocessing unit comprises a hydrotreater and a hydrocracker.

13. The process of claim 4, wherein the hydroprocessing unit comprises a hydrotreater, a hydrocracker, and a catalytic dewaxing unit.

14. The process of claim 13, wherein the hydroprocessing unit further comprises a hydrofinisher.

15. The process of claim 13, wherein the hydrocracker operates with a temperature controlled contaminant laydown technique guard bed.

16. The process of claim 15, wherein the catalytic dewaxing unit operates with a temperature controlled contaminant laydown technique guard bed.

17. The process of claim 1 wherein the average bed temperature is incrementally increased during the run.

18. The process of claim 17 wherein the start of run (SOR) temperature is about 400° F. and the end of run (EOR) temperature is 750° F.

19. The process of claim 1 wherein the average bed temperature is incrementally decreased during the run.

20. The process of claim 19 wherein the start of run (SOR) temperature is about 750° F. and the end of run temperature (EOR) is 400° F.

* * * * *